US005464061A

United States Patent [19]

Wilson et al.

[11] Patent Number: 5,464,061

[45] Date of Patent: Nov. 7, 1995

[54] CRYOGENIC COAL BED GAS WELL STIMULATION METHOD

[75] Inventors: Dennis R. Wilson; Robert M. Siebert; Pat Lively, all of Ponca City, Okla.

[73] Assignee: Conoco Inc., Ponca City, Okla.

[21] Appl. No.: 356,593

[22] Filed: Dec. 14, 1994

[51] Int. Cl.[6] ..... E21B 43/25; E21B 43/263

[52] U.S. Cl. ..... 166/302; 166/305.1; 299/16

[58] Field of Search ..... 166/242, 57, 299, 166/302, 308, 305.1; 299/12, 16

[56] References Cited

U.S. PATENT DOCUMENTS

| | | | |
|---|---|---|---|
| 4,391,327 | 7/1983 | DeCarlo | 166/307 |
| 4,400,034 | 8/1983 | Chew | 166/307 X |
| 4,534,413 | 8/1985 | Jaworowsky | 166/302 |
| 4,544,037 | 10/1985 | Terry | 299/12 X |
| 5,085,274 | 2/1992 | Puri et al. | 166/252 |
| 5,147,111 | 9/1992 | Montgomery | 299/16 |

*Primary Examiner*—David J. Bagnell
*Attorney, Agent, or Firm*—John E. Holder

[57] ABSTRACT

Methane gas recovery from wells extending into subterranean coal seams is stimulated by treatment of near-wellbore coal seam with cryogenic liquid.

11 Claims, No Drawings

CRYOGENIC COAL BED GAS WELL STIMULATION METHOD

BACKGROUND OF THE INVENTION

1. Field of the Invention

This invention relates to recovery of methane gas from subterranean coal seams. More particularly, the invention relates to a process wherein cryogenic liquid such as liquid nitrogen is utilized to increase the permeability of the portion of a coal seam penetrated by a wellbore.

2. Description of the Prior Art

Subterranean coal seams typically contain large volumes of methane. In the case of a mineable coal seam, it is desirable from a safety standpoint to produce as much of the methane as possible before beginning mining operations. In deeper coal seams, not amenable to conventional mining techniques, the methane constitutes a recoverable energy source which can be produced by conventional gas production methods.

Presently, methane is produced through wells drilled into the coal seams. Once a well is drilled and completed, it is common to treat the coal seam in order to stimulate the production of methane therefrom. One commonly used stimulation treatment involves hydraulically fracturing the coal seam much in the way other more conventional gas bearing formations are fractured. However, conventional hydraulic fracturing processes involve producing the fracturing fluid back through the wellbore, and this sometimes leaves permeability-reducing debris in the formation, and proppant sand often plugs horizontal wells. Gaseous fracturing fluids produce problems because of inability to adequately carry proppants and flow diverters, and foam fracturing fluids often leave flow-reducing residues. Also, sand or similar proppants sometimes produce back, plugging the well and/or damaging surface production equipment.

Another technique which has been proposed for stimulating a coal seam is one which is sometimes referred to as "cavity induced stimulation". In one form of that process, a wellbore is charged with a gas followed by a water slug. The well pressure is then reduced and the injected gas and water produce back and create a cavity by breaking up coal around the borehole face.

Cycling of the gas-water injection and blowdown followed by debris cleanout produces an enlarged wellbore cavity. However, this technique is not effective on many coal seams.

A variation of the cavity induced stimulation process in which liquid carbon dioxide is injected into the coal seam is described in U.S. Pat. No. 5,147,111 to Montgomery.

A method of stimulating water flow from a dry well is described in U.S. Pat. No. 4,534,413. That method involves alternate pressurization and depressurization of a well with liquid or gaseous nitrogen or carbon dioxide to fracture the borehole surface.

While the above-described processes have improved methane production in many cases, there remains a need for an improved stimulation process which is cheaper, safer and more effective than currently available processes.

SUMMARY OF THE INVENTION

According to the present invention, a coal seam gas production stimulation process is provided that effectively improves methane production rates even from coal seams that are not responsive to conventional stimulation procedures.

An essential feature of this invention is the use of liquid nitrogen to treat the near wellbore area of a coal seam. The extreme cold of liquid nitrogen, combined with the low thermal conductivity of coal and the shrinkage of coal at lowered temperature, creates a severe thermal stress area where warm coal meets cold coal. The resulting stress causes the coal to become weak and friable. Also, the water within the coal matrix is quickly frozen at the point of contact with liquid nitrogen, and the resulting swelling during ice formation contributes to crumbling and disintegration of the coal. Further, liquid nitrogen has a very low viscosity, and will penetrate into cleats, fractures and voids, where expansion of nitrogen as it warms further contributes to weakening and fracturing of the coal.

A further essential feature of the invention involves providing a heat transfer barrier between the liquid nitrogen which is pumped down a well tubing and the portion of the well outside the tubing. Wells to be treated generally are lined with a steel casing, and without a heat transfer barrier the temperature generated by the injected liquid nitrogen flowing through the well tubing could cause the well casing to fail. Also, a high rate of heat transfer through the tubing could cause an excessive amount of liquid nitrogen vaporization in the tubing. A twofold approach to creating a heat transfer barrier involves (1) using a tubing having a low thermal conductivity (preferably fiberglass tubing, which maintains its strength at liquid nitrogen temperature), and (2) flowing a warm gas down the well annulus during liquid nitrogen injection to insulate the well casing from the cold tubing.

In one aspect, a modified "cavity induced stimulation" is used in which a gas (air or gaseous nitrogen) is injected into the near wellbore portion of the coal seam. A slug of water follows the gas injection, and after the water is displaced into the wellbore face it is followed with a slug of liquid nitrogen. The nitrogen freezes the borehole coal surface as well as the water near the face. The well is then depressurized, and the pressure in the coal seam acts to blow the wellbore skin into the wellbore and create a cavity. The procedure can be repeated as desired with cleanout of debris as appropriate. It has been found that repeated contact of coal with liquid nitrogen results in progressively smaller coal particles.

In a modification of the above process, either in addition to or in lieu of the steps described, the coal seam is injected with liquid nitrogen at formation fracturing pressure. In a further variation, the liquid nitrogen can include water ice particles which act as a temporary proppant for the fracturing process. The coal seam is a heat source for the liquid nitrogen, and as the nitrogen flows into newly created fractures it will be vaporized. The expansion will contribute to the fracturing energy. A particular advantage of this process is that the fracturing fluid is produced back as a gas, avoiding the potential for formation damage which some fracturing fluids cause.

In still another aspect of the invention, a difficult to handle treatment chemical can be incorporated in the liquid nitrogen and transported to the coal seam. For example, acetylene gas is unstable at pressures over 80 psig, but it can be frozen into solid pellets and pumped in with liquid nitrogen. When the acetylene warms, it will be in an area where the pressure is several hundred psi, and it will explode violently of its own accord, providing a type of explosive fracturing not heretofore available.

DESCRIPTION OF THE PREFERRED EMBODIMENTS

An essential feature of this invention involves transporting liquid nitrogen from a source to a coal seam. Ordinary steel is not suitable for this service, so other materials must be utilized. Stainless steel piping can be used to transfer liquid nitrogen to a wellhead manifold (also of stainless steel), and a tubing string of fiber glass pipe or its equivalent connected to the manifold and extending down the well is a preferred mode. Fiber glass tubing preferred over stainless steel tubing because it is a lower cost, lighter weight and lower thermal conductivity material than stainless steel. The manifold preferably includes provisions for flowing material from several sources into the tubing string.

All embodiments of this invention involve injection of liquid nitrogen down the wellbore. There has been concern that the extremely low temperatures involved could damage the ordinary steel casings typically used to complete the wells. The casings normally extend to the top of the coal seam. This problem is overcome by injecting a flow of warm air or nitrogen gas downward through the annulus formed by the well casing and the fiber glass tubing when liquid nitrogen is being injected down the tubing.

There are many advantages to using liquid nitrogen as opposed to liquid carbon dioxide in the process. Primarily, liquid nitrogen is much colder than liquid carbon dioxide. Also, nitrogen is inert to coal, whereas carbon dioxide is reactive with coal and can cause swelling with resultant permeability reduction.

BOREHOLE ENLARGEMENT EMBODIMENT

In this embodiment, a gas such as air or nitrogen is first injected into the near wellbore area of a coal seam. The gas is followed by a water slug, which is then displaced into the near wellbore area, such as by injection of gaseous nitrogen down the injection tubing. After the injection tubing and borehole are substantially free of water, liquid nitrogen is injected down the tubing to contact the borehole face and create thermal stresses at the borehole face. The liquid nitrogen thermally weakens the contacted coal and also freezes the water in the coal immediately surrounding the wellbore, creating a temporary face skin at least partially sealing the borehole surface to flow in either direction. At least while liquid nitrogen is being pumped down the tubing, warm gas is simultaneously injected down the annulus to insulate the well casing from the low temperature created by liquid nitrogen flowing down the tubing.

After injection of liquid nitrogen is complete, the well is depressured, and the combination of natural coal seam pressure and the gas injected into the coal seam acts to blow out the wellbore surface face, which as mentioned previously has been weakened by thermal stresses and the expansion forces of water freezing in the coal matrix.

The process may be repeated several times, depending on the extent of cavity enlargement desired. The resulting debris may be removed one or more times prior to placing the well on methane production.

COAL SEAM FRACTURING EMBODIMENT

In this embodiment, which may be in addition to the above-described cavity enlargement process, or which may be a stand-alone process, liquid nitrogen is injected down the wellbore through a fiberglass tubing or its equivalent, while gaseous air or preferably gaseous nitrogen is injected down the well through the annulus formed by the well casing and tubing. The liquid nitrogen is pumped at fracturing pressure, and the thermal effects enhance the fracturing as liquid nitrogen is forced into a new fracture, newly exposed warm coal is contacted, vaporizing some nitrogen to increase or support the fracturing pressure.

The fiberglass tubing has low heat conductivity and capacity, so only a small amount of the liquid nitrogen is vaporized in the tubing during the pump down.

In a particularly preferred embodiment, water ice crystals are utilized as a temporary proppant and flow diverter in the fracturing process. The crystals may be formed by spraying water into the liquid nitrogen either in the well or at the surface. A major advantage in the process is that the nitrogen will vaporize and the ice will melt and/or vaporize so that both will flow back without leaving a permeability-damaging residue as conventional fracturing fluids do.

In a further variation of the fracturing process, a water slug may precede the nitrogen injection. The water tends to fill existing fractures and as it would quickly freeze on contact with liquid nitrogen it would prevent premature leak off and also act as a flow diverter. When a water slug precedes the nitrogen, the water has to be cleared from the injection tubing and from the borehole prior to liquid nitrogen injection to prevent ice formation and plugging. This is preferably done by following the water slug with a gas purging step.

THE CHEMICAL TREATMENT EMBODIMENT

In this embodiment, a treatment chemical which is difficult to handle at ambient conditions, because of volatility or reactivity, for example, can be incorporated in a liquid nitrogen stream which allows for safe handling and injection of the chemical.

When the injected chemical is warmed by the formation to be treated, the desired reaction can take place safely. For example, acetylene gas is unstable at pressures above 15 psi, but it can be frozen into solid pellets with liquid nitrogen and pumped into a well. When it is warmed by the formation, it will be at a pressure of several hundred psi and will explode violently without the need for a co-reactant or detonator. The resulting explosive fracturing may be part of a combination treatment or an independent process. As in the other embodiments, injection of a warm gas through the well annulus during liquid nitrogen injection through the tubing prevents thermal damage to the well casing.

DESCRIPTION OF EQUIPMENT

The extremely low temperature of liquid nitrogen presents special problems in carrying out the invention. Ordinary carbon steel is not suitable for cryogenic service, so the injection tubing must be specially designed. A preferred tubing material is fiberglass piping, which maintains its strength at liquid nitrogen temperatures, and has a low heat conductivity. Tubing centralizers are preferably used to maintain uniform spacing between the tubing and the well casing. The tubing is adapted to connect to an above ground manifold, which can be of stainless steel, and stainless steel or other appropriate cryogenic piping can extend from the manifold to the liquid nitrogen source. The liquid nitrogen source is preferably one or more transportable tanks, each of which is connected to the manifold. A gaseous nitrogen source also may be connected to the manifold by appropriate means. The gaseous nitrogen source preferably is a liquid nitrogen tank with a heat exchanger at the tank's discharge for warming and gasifying the nitrogen. A water source may also be connected to the manifold if water is to be injected. The manifold needs to be capable of directing gaseous nitrogen down both the well annulus to provide low temperature protection for the casing, and down the tubing to purge water from the tubing to prevent plugging of the tubing with ice.

A spray injector to provide ice crystals in the liquid nitrogen or to add a treatment chemical to the liquid nitrogen may be located in the well or above ground as appropriate.

The foregoing description of the preferred embodiments is intended to be illustrative rather than limiting of the invention, which is to be defined by the appended claims.

We claim:

1. A method for improving methane production from a cased wellbore extending into a subterranean coal seam comprising:

(a) providing a tubing in said wellbore for conveying liquid nitrogen from the surface to said coal seam;

(b) providing a heat transfer barrier between the wellbore casing and the interior of said tubing;

(c) injecting liquid nitrogen through said tubing to said coal seam whereby the face of said wellbore adjacent said coal seam is contacted with liquid nitrogen; and (d) producing methane gas from said coal seam through said wellbore.

2. The method of claim 1 wherein a gas is injected into said coal seam adjacent said wellbore prior to said injection of liquid nitrogen.

3. The method of claim 2 wherein water is injected into said coal seam adjacent said wellbore after said injection of gas and prior to said injection of liquid nitrogen.

4. The method of claim 1 wherein said coal seam adjacent said wellbore is contacted with liquid nitrogen a plurality of times followed by production of methane therefrom.

5. The method of claim 1 wherein said liquid nitrogen contains an added treatment chemical which is reactive in said wellbore after injection thereinto.

6. The method of claim 5 wherein said treatment chemical comprises pellets of frozen acetylene.

7. The method of claim 1 wherein said liquid nitrogen is injected into said coal seam at a pressure exceeding the fracture pressure of said coal seam.

8. The method of claim 7 wherein said liquid nitrogen includes water ice particles.

9. The method of claim 1 wherein a gas is flowed down the annulus between said casing and said tubing during injection of said liquid nitrogen.

10. The method of claim 9 wherein said tubing is fiber glass tubing.

11. A method of improving methane production from a wellbore extending into a subterranean coal bed comprising:

(a) providing a wellbore from the surface through said coal seam;

(b) casing said wellbore from the surface to adjacent the top of said coal seam;

(c) providing a tubing string through said wellbore from the surface to a point adjacent said coal seam;

(d) charging said coal seam by injecting a gas down said wellbore and into said coal seam;

(e) injecting a slug of water into said coal seam behind said injected gas;

(f) injecting a gas behind said water slug to clear water from said tubing and wellbore;

(g) injecting liquid nitrogen into said coal seam at fracturing pressure;

(h) displacing liquid nitrogen into said coal seam from said tubing and borehole;

(i) closing said well to enable said liquid nitrogen to warm up and vaporize; and (j) opening said well to enable vaporized nitrogen to flow out followed by production of methane gas from said well.

* * * * *